US010954114B1

(12) United States Patent
Cody

(10) Patent No.: US 10,954,114 B1
(45) Date of Patent: Mar. 23, 2021

(54) ELEVATED TANK WITH INTEGRATED TANK STAND

(71) Applicant: Steve Cody, Coalgate, OK (US)

(72) Inventor: Steve Cody, Coalgate, OK (US)

( * ) Notice: Subject to any disclaimer, the term of this patent is extended or adjusted under 35 U.S.C. 154(b) by 0 days.

(21) Appl. No.: 16/873,689

(22) Filed: Jun. 1, 2020

(51) Int. Cl.
*B67D 3/00* (2006.01)

(52) U.S. Cl.
CPC ..... *B67D 3/0083* (2013.01); *B67D 3/0061* (2013.01)

(58) Field of Classification Search
CPC ..... B67D 3/0083; B67D 3/0061
See application file for complete search history.

(56) References Cited

U.S. PATENT DOCUMENTS 2,457,155 A * 12/1948 Jackson ..... B65D 90/14 137/342
2,555,822 A * 6/1951 Smith ..... E01H 1/053 15/50.1
2,620,097 A * 12/1952 Titmas ..... E03D 9/037 222/453
3,002,540 A * 10/1961 Monroe ..... B67C 3/26 141/308
3,160,171 A * 12/1964 Klein ..... B60P 3/22 137/899.3
3,266,675 A * 8/1966 Willis ..... B60P 3/2215 222/160
3,315,929 A * 4/1967 Keiser ..... B65D 90/16 137/899.3
3,352,461 A * 11/1967 Dascanio ..... E03B 11/10 222/160
3,407,836 A * 10/1968 Keiser ..... B65D 90/16 137/899.3
3,658,211 A * 4/1972 Kitchens ..... B65D 90/582 222/185.1
3,709,251 A * 1/1973 Manor ..... B60P 3/00 137/343
4,022,331 A * 5/1977 Bean ..... A01M 7/0085 414/555
4,041,974 A * 8/1977 Keiser ..... B60P 3/22 137/899.3
4,416,396 A * 11/1983 Ward ..... B60K 15/06 222/129
4,660,336 A 4/1987 Cazaly
D393,332 S * 4/1998 Nygren ..... D32/1
5,971,009 A * 10/1999 Schuetz ..... B65D 90/30 137/264
6,318,034 B1 * 11/2001 Zavitz ..... E04H 12/30 52/194

(Continued)

*Primary Examiner* — Frederick C Nicolas
(74) *Attorney, Agent, or Firm* — Randal Homburg

(57) ABSTRACT

An elevated fuel delivery assembly utilizing integrated legs within sleeves attached to a tank provides a gravity flow dispensation of stored liquids within the tank, primarily fuel, by providing the tank with attached at least two parallel sleeves defining sleeve channels slidably engaging at least two parallel upright legs extending from a common base member, providing the tank with a lowered position and a raised position, locking the integrated upright legs at a selected height, suspending the tank at a chosen height using locking bolts and set screws to secure the integrated legs within the respective sleeve channels, stabilizing the tank and contained stored liquids in remote locations for subsequent dispensing of the contents.

4 Claims, 5 Drawing Sheets

(56) References Cited

U.S. PATENT DOCUMENTS

| | | | | |
|---|---|---|---|---|
| 7,487,619 | B2 * | 2/2009 | Glenn | E04H 12/30 220/565 |
| D665,955 | S * | 8/2012 | DeWall | D32/1 |
| 8,245,889 | B1 * | 8/2012 | Starns | B67D 7/04 222/399 |
| 8,529,845 | B2 * | 9/2013 | Kois | B01F 15/00785 422/261 |
| 9,566,953 | B2 | 2/2017 | Cajiga | |
| 9,808,107 | B2 * | 11/2017 | Baker | A47J 27/04 |
| 10,337,662 | B1 * | 7/2019 | Gradillas | E03C 1/18 |
| 10,604,403 | B2 * | 3/2020 | Schmidt | F16K 31/265 |
| 2004/0084065 | A1 * | 5/2004 | Edelmann | A47L 15/4244 134/18 |
| 2005/0115606 | A1 * | 6/2005 | Chisholm | B67D 7/007 137/142 |
| 2017/0275149 | A1 | 9/2017 | Schmidt | |

* cited by examiner

ELEVATED TANK WITH INTEGRATED TANK STAND

CROSS REFERENCE TO RELATED APPLICATIONS

None.

I. BACKGROUND OF THE INVENTION

1. Field of Invention

A elevated fuel delivery assembly suppling a quantity of fuel in remote locations, the elevated fuel delivery assembly comprising a liquid tank with sleeves accepting slidable integrated legs to raise and lower the tank upon the integrated legs, the raised position providing for gravity flow dispensing of the tank contents.

2. Description of Prior Art

A preliminary review of prior art patents was conducted by the applicant which reveal prior art patents in a similar field or having similar use. However, the prior art inventions do not disclose the same or similar elements as the present liquid storage tank, nor do they present the material components in a manner contemplated or anticipated in the prior art.

There are numerous elevated fuel tanks that are for sale in the market, providing 100-500 gallon fuel tanks that provide for gravity flow dispensing through an attached hose and dispensing valve. No patents were found for this product which is widely used by farmers, ranchers and construction sites to dispense fuel for vehicles or equipment. Very few relevant prior art patents or applications were noted, but deal with water towers, U.S. Pat. No. 6,318,034 to Zavitz, and U.S. Pat. No. 4,660,336 to Cazaly, a mobile fuel distribution station identified in U.S. Pat. No. 9,566,953 to Cajiga, and a multi-line tanker trailer elevation stand shown in U.S. Pub. No. 2017/0275149 to Schmidt, which raises and suspends an entire fuel tank trailer above the ground for dispensing fuel.

II. SUMMARY OF THE INVENTION

Remote locations require fuel storage and delivery systems of bulk liquid fuels to avoid having to travel great distances for refueling. Large capacity vessels, defined within this specification as storage containers between 100 gallons and several thousands of gallons, are provided with either a powered delivery system, or more practically, using a gravity fed liquid dispensing means, involving a hose and a dispensing spigot, thus avoiding a power supply to transfer the liquid fuel from the storage container to the vehicle or equipment for refueling.

Most of the tanks are simple container having a lower fuel bung within which a hose is installed with the above noted spigot, with the tank being placed on a frame with the tank being filled by periodic delivery. In the case of common elevated fuel tanks for farm equipment supply, the tank is located in a centrally provided rural area and the farm equipment is brought to the delivery tank, refueled and placed back into service. In construction or mining operations, the tanks are placed in the mining or construction yard, with each relevant fueled equipment being brought to the tank for frequent refueling. In all cases, the elevated fuel tank reduces the cost of frequent fuel delivery or costly travel for refueling, and often results in a quantity discount for fuel purchase.

The prior elevated fuel delivery systems either provide the frame separate from the tank, or with the frame or stand actually welded to the tank. The present elevated fuel tank provided the support structure for the elevated tank integrated into the tank with the ability to raise and lower the tank to extend or retract the legs for delivery of the tank to a site in a retracted leg position, lowering the center of gravity of the tank during movement for stability, and then extending the legs once located to raise the tank to an elevated adjustable height for placement to dispense the fuel. This location may be permanent or temporary, depending on the use of the present elevated fuel delivery system. For example, for farming, the tank may very well be established in a location where it is seldom moved, remaining at the main farm location and only moved during a harvest event. In construction, the elevated fuel delivery system may be moved every time the construction company relocates to a new project until conclusion of the project. This would be a similar situation for oil and gas exploration, drilling and completion. For mining operations, the tank would remain near the mine until conclusion of the mining event.

The retracted position lowering the center of gravity is especially beneficial from a transport, safety and control standpoint where there is fuel within the tank during transport, preventing top-heavy accidents from occurring. There are many other benefits that those requiring portable and remote fuel delivery systems may realize during use of this elevated fuel delivery systems.

III. DESCRIPTION OF THE DRAWINGS

The following drawings are submitted with this utility patent application.

IV. DESCRIPTION OF THE PREFERRED EMBODIMENT

Figure 1:
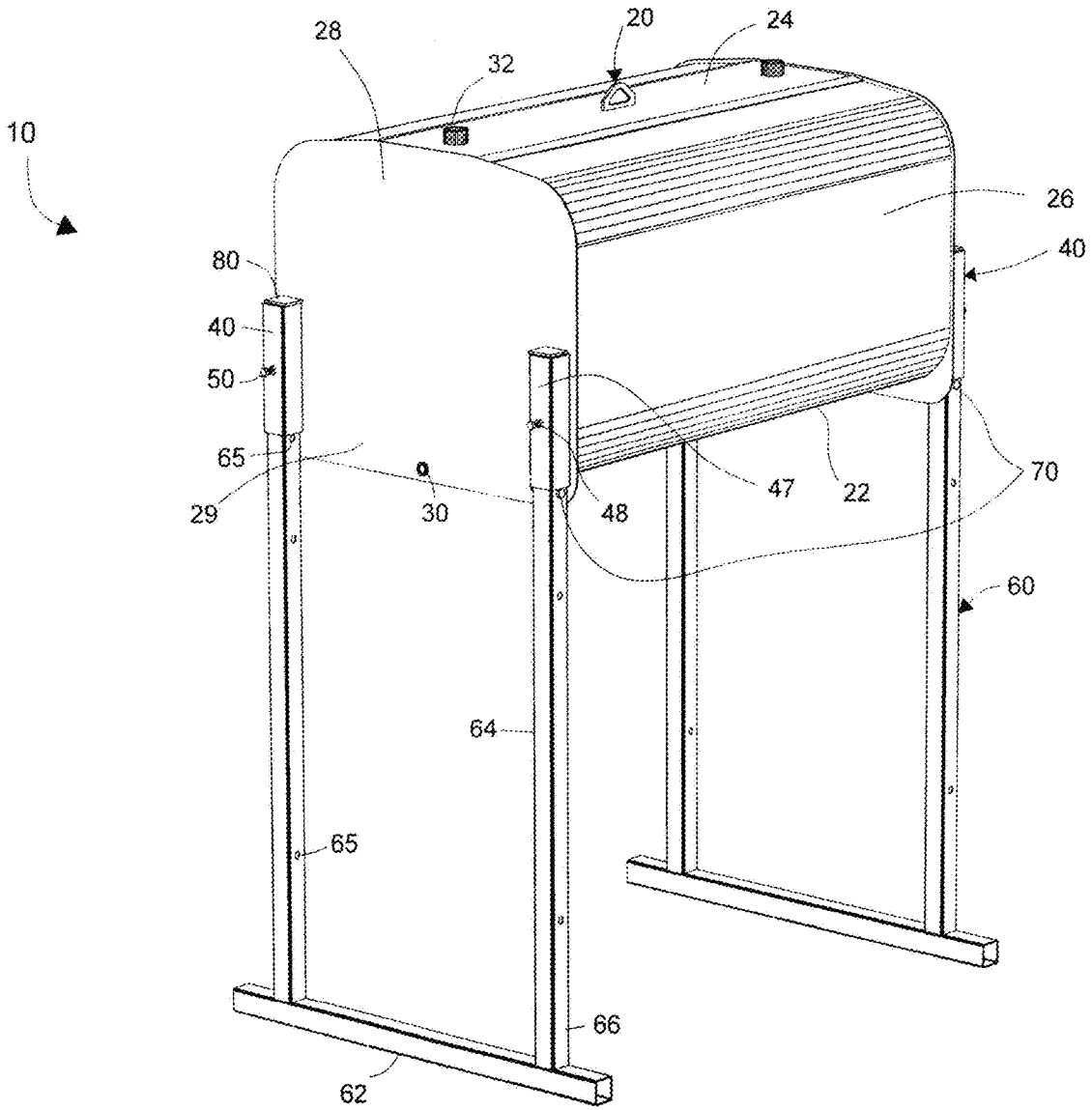
FIG. 1 is a perspective view of the elevated fuel delivery assembly in an elevated position.

An elevated fuel delivery assembly 10, providing for gravity flow dispensing of fuel as shown in FIGS. 1-5, comprises a liquid tank 20, having a capacity between 100 gallons and 1000 gallons, with at least a pair of integrated leg assemblies 60 slidably engaging two sets of parallel vertical sleeves 40 attached to opposing end panels 28 of the liquid tank 20, enabling the tank 20 placed in a lowered position for transport, loading and unloading, and a raised position for dispensing the contents of the liquid tank. The purpose of the elevated fuel delivery assembly 10 is to provide for a bulk capacity fuel delivery system in remote locations for vehicles and equipment in agricultural, construction and mining operations, as well as other practical uses.

The tank 20 further provides a closed vessel comprising a floor 22, a ceiling 24, side panels 26 and the two opposing end panels 28 forming a fuel cavity 25. It is most preferable that the tank is symmetrical for balance purposes, although it is not essential. The shape of the tank 20 may be rectangular, cylindrical or other, with shape not being an essential factor in the purpose or function of the elevated fuel delivery system 10. In at least one end panel 28, there is a lower bung hole 30 providing a threaded opening between the fuel cavity 25 and the end panel 28, accepting the connection of a hose 100 and controlled dispensing spigot 102, and an upper fill cap 32 with a ventilation capacity, FIG. 5.

Figure 3:
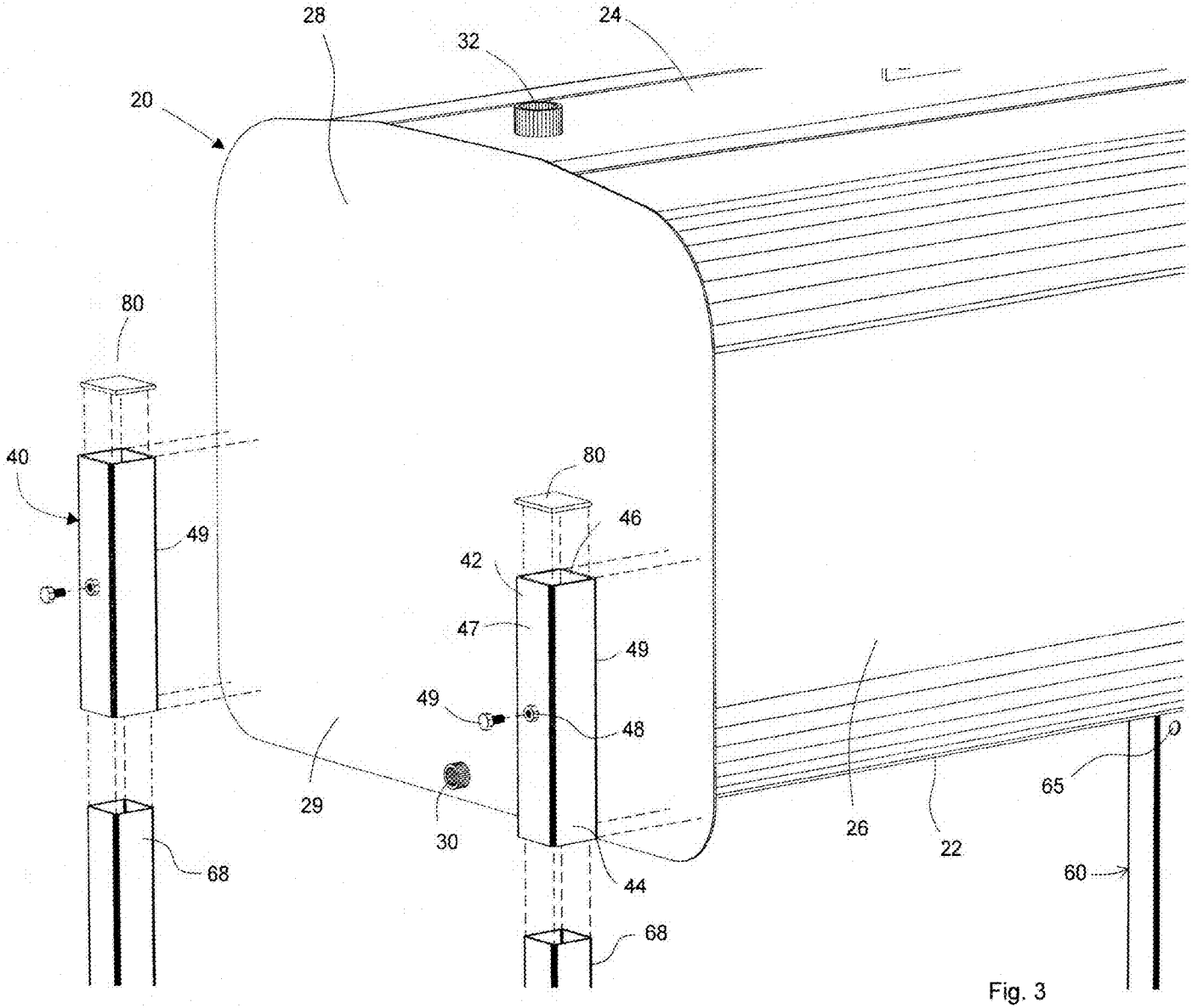
FIG. 3 is an exploded view of a side perspective of the elevated fuel delivery assembly, showing the sockets with the set screws, the tank side, the upper ends of the leg members, and the leg cap, with the fuel cap and the tank bung hole shown.
Figure 4:
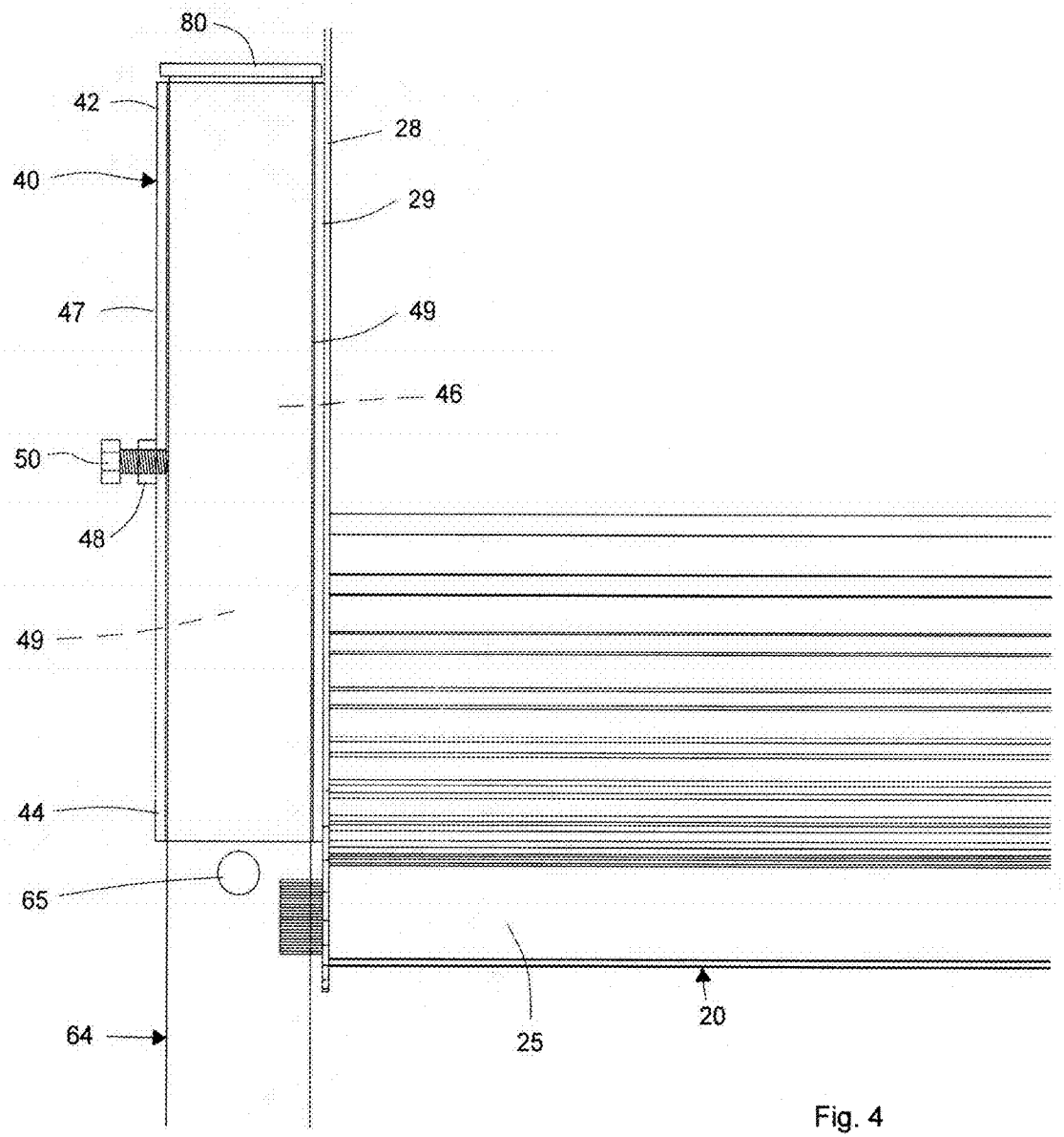
FIG. 4 is a side cross sectional view of a tank end, socket and upper end of a leg in the elevated position with the set screw engaged against the outer surface of the leg.
Figure 5:
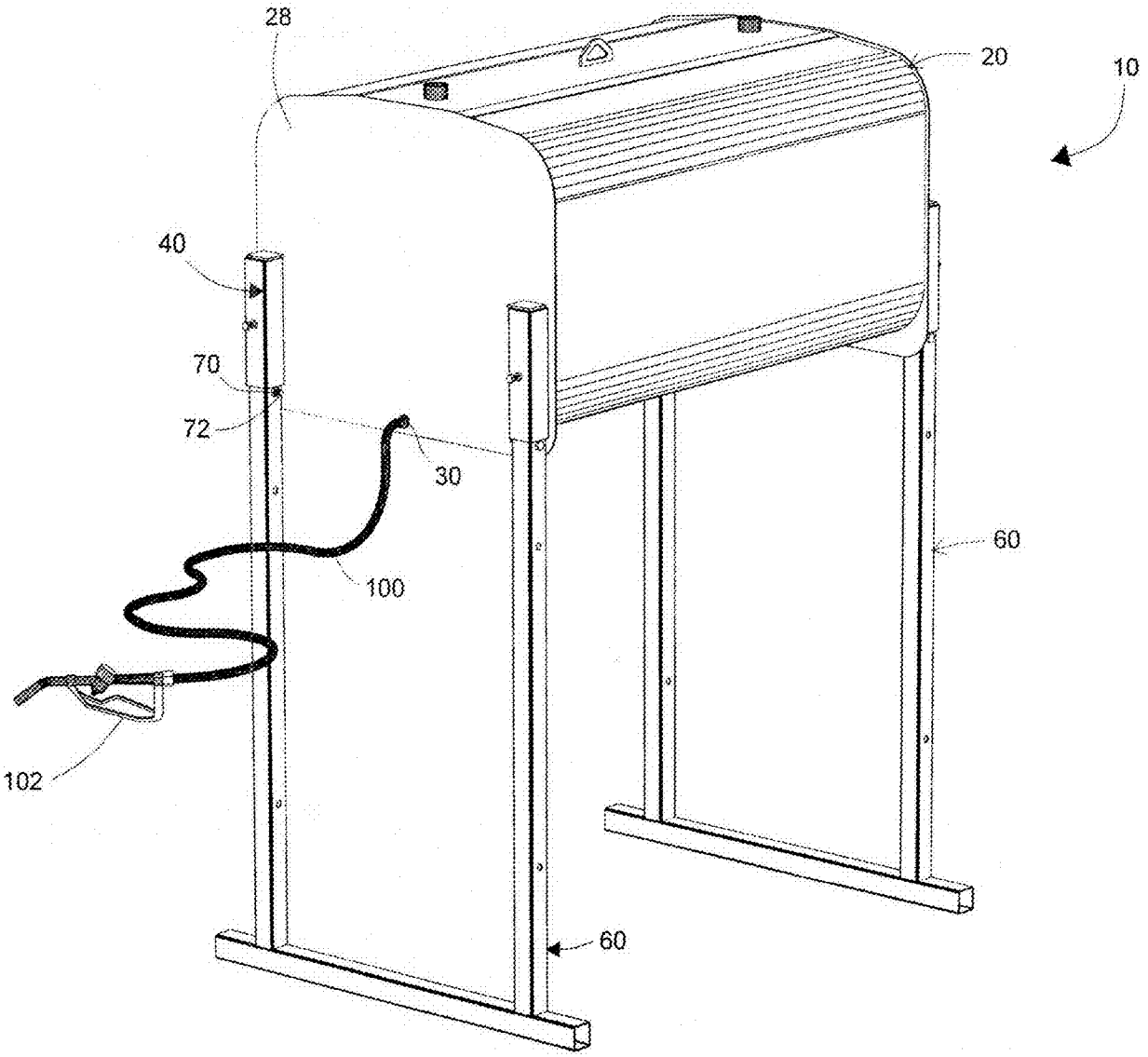
FIG. 5 is a perspective view of FIG. 1 including a hose and a spigot for dispensing fuel.

On each of the two opposing end panels 28, each of the two vertically oriented sleeves 40 define an upper end 42, a lower end 44, an inner channel 46, a front surface 47 and a rear surface 49, FIGS. 3-4. The rear surfaces 49 are welded to an external surface 29 of each end panel 28 in parallel with the front surfaces 47 including a threaded bore 48.

There are at least two sets of integrated leg assemblies 60, each integrated leg assembly 60 providing a flat base member 62 extending two upright parallel legs 64. Each leg 64 further defining a base end 66, attached to the flat base member 62 and an upper end 68, which are contemporaneously inserted through respective lower ends 44 into the Timer channel 46 of each vertically oriented sleeve 40, as shown in FIG. 3. An outside circumference of each leg 64 is uniform and smaller than the inside circumference of each inner channel 46 of each sleeve 40 so that the leg 64 may slide freely within the sleeve 40, the leg 64 and inner channel 46 of each sleeve 40 additionally conforming is shape including square, circular, rectangular or other conforming shape. Additionally, the spacing of the sleeves 40 should be coordinated with the spacing of the paired legs 64 so that they are capable of engagement and integration. The drawing figures depict two legs 64 and two sleeves 40 per side, but the number of legs 64 and sleeves 40 per side may be provided in greater numbers, thereby amending the requirements to at least two sleeves 40 per side and at least two legs 64 per integrated leg assembly 60, should the capacity of the tank 20 or selection of the materials used in the construction of the elevated fuel delivery assembly 10 may require provided the above criteria are met.

Additionally, each leg 64 defines a plurality of spaced axial bores 65 providing for multiple height adjustments selected by the user to determine the chosen elevation of the tank 20 along the each integrated leg assembly 60, with respective locking bolts 70 and nuts 72 inserting through the respective axial bores 65 in each leg 64 to affix the height of the tank 20 in relationship to the integrated leg assemblies 60. An upper cap 80 is affixed onto an upper end 68 of each leg 64, FIGS. 3 and 4, to prevent the legs 64 from being removed from within the sleeves 40 subsequent to the manufacturing process, thereby preventing removal of each leg 64 within each sleeve 40, with vertical adjustment limited between a fully lowered position, FIG. 2, and a fully raise position, as shown in FIG. 1. Once the height is set by the attachment of the locking bolts 70 and nuts 72, a set screw 50, inserted within each threaded bore 48 of each front surface 47 of each sleeve 40 to further stabilize each leg 64 within each sleeve 40 to prevent sway or rocking of the elevated tank 20 upon the integrated legs during use.

Figure 2:
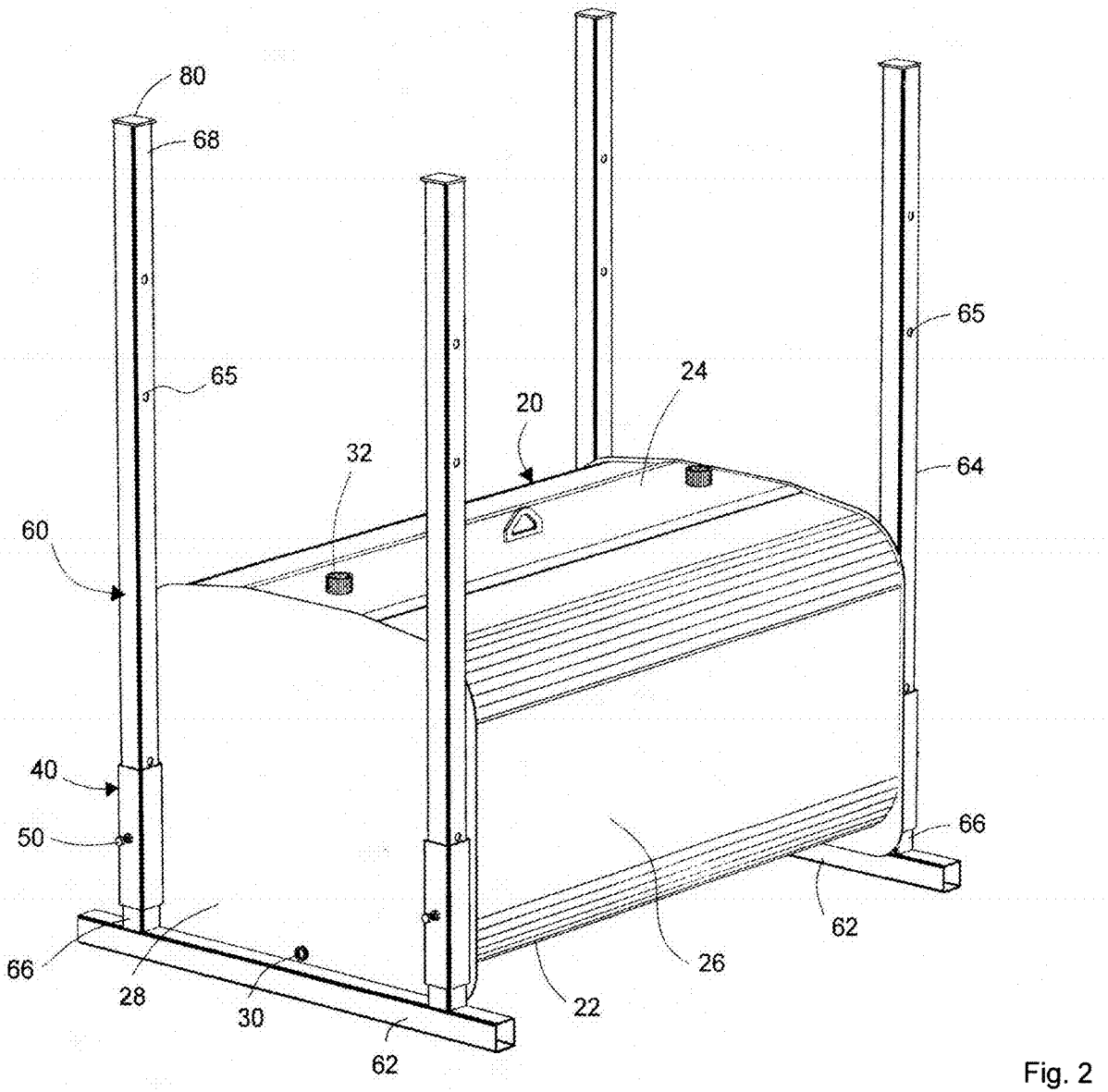
FIG. 2 is a perspective view of the elevated fuel delivery assembly in a lowered position.

The general use of the elevated fuel delivery system 10 would be for the user to obtain the elevated fuel delivery system 10 in the lowered position, FIG. 2, with an empty tank 20, providing the most stable and safe transport embodiment. The tank could also be delivered full of fuel, but it would increase the weight during transport and also enhance the safety risk of a full fuel tank 20 during transport.

Upon delivery and location, the tank 20 would be raised, FIG. 1, upon each set of integrated leg assemblies 60 to a chosen height by available lift means, with the locking bolts 70 inserted through the selected axial bores 65 within each leg 64 and securing the nut 72 to each locking bolt 70. Each set screw 50 is then installed within each threaded bore 48 of each sleeve 40. The hose 100 and spigot 102 would then be installed within the bung hole 30 of the tank 20, FIG. 5. The tank would be filled and would then be ready for the dispensing of the tank contents, which may be gasoline, kerosine, diesel or another liquid of the user's choice by gravity flow. Most practical use would be remote locations, including farm land, harvest locations, building construction sites, mining operations, road construction locations or any other remote location where the disclosed elevated fuel delivery assembly 10 would be useful.

While the elevated fuel delivery assembly 10 has been particularly shown and described with reference to a preferred embodiment thereof, it will be understood by those skilled in the art that changes in form and detail may be made therein without departing from the spirit and scope of the invention.

What is claimed is:

1. An elevated fuel delivery assembly providing remote storage and dispensing of fuel or other bulk liquids at remote locations, comprising:

a tank defining a floor, ceiling, at least two side panels, at least two end panels providing a fuel cavity, with a lower bung hole located in at least on or said at least two end panels, and an upper fill cap within the ceiling;

at least two vertically oriented sleeves attached to each said at least two end panels, each said sleeve defining an inner channel, an upper end, a lower end, a front surface, and a rear surface attaching to an external surface of each said at least two end panels;

at least two integrated leg assemblies, each said leg assembly defining a lower base member, at least two upwardly extending legs defining an upper end and base end attached to said flat base member and further defining a plurality of vertically spaced axial bores; and a hose having a dispensing spigot attached within said at least one bung hole, wherein each said upper end of each said leg is slidably engaged within each respective said inner channel of each said sleeve to raise said tank from a lowered position to a selected raised position with a locking bolt inserted through a selected axial bore within each said leg to secure said tank at a selected raised position providing the elevated fuel tank with gravity flow dispensing of the contained fuel or other liquid content.

2. The elevated fuel delivery assembly of claim 1, further comprising:

a threaded bore through the front surface of each said sleeve receiving a set screw tightened against each said leg inserted within said inner cavity of said sleeve, said set screw applied against said leg subsequent to the insertion of each said locking bolt; and each said locking bolt secured in place by a locking nut to further stabilize the tank upon the leg assemblies while in said raised position.

3. The elevated fuel delivery assembly of claim 1, further comprising said tank capacity is between 100 and 1000 gallons.

4. The elevated fuel delivery assembly of claim 1, wherein each said integrated leg assembly and said sleeve are made from square tubular steel and said tank is also made of steel with said sleeves attached to each said end panel by welding said rear surface of each said sleeve to said external surface of each said end panel.

* * * * *